US009591909B2

(12) United States Patent
Schreiber et al.

(10) Patent No.: US 9,591,909 B2
(45) Date of Patent: Mar. 14, 2017

(54) APPLICATOR FOR A COSMETIC PRODUCT, IN PARTICULAR MASCARA AND METHOD OF PRODUCING SUCH AN APPLICATOR

(71) Applicant: ALBEA SERVICES, Gennevilliers (FR)

(72) Inventors: Camille Schreiber, Paris (FR); Anne Rutigliano, Maisons-Laffitte (FR); Patrick Lhoyer, Mouy (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 14/666,939

(22) Filed: Mar. 24, 2015

(65) Prior Publication Data

US 2015/0272301 A1 Oct. 1, 2015

(30) Foreign Application Priority Data

Mar. 25, 2014 (FR) ..... 14 52513

(51) Int. Cl.

| | |
|---|---|
| ***A46B 9/02*** | (2006.01) |
| ***A45D 40/26*** | (2006.01) |
| ***A46B 3/18*** | (2006.01) |
| ***A46D 3/05*** | (2006.01) |
| ***A46D 1/04*** | (2006.01) |

(52) U.S. Cl.

CPC ..... *A45D 40/265* (2013.01); *A46B 3/18* (2013.01); *A46B 9/021* (2013.01); *A46B 9/028* (2013.01); *A46D 1/04* (2013.01); *A46D 3/05* (2013.01); *A46B 9/026* (2013.01); *A46B 2200/1053* (2013.01)

(58) Field of Classification Search

CPC ..... A46B 9/026; A46B 9/028
USPC ..... 15/206, 207; 132/218, 317; 401/129
See application file for complete search history.

(56) References Cited

U.S. PATENT DOCUMENTS 7,171,969 B2 * 2/2007 Gueret ..... A46B 9/021 132/218
8,082,928 B2 * 12/2011 Gueret ..... A46B 9/021 132/218

(Continued)

FOREIGN PATENT DOCUMENTS

EP 1236419 A1 9/2002
FR 2811525 A1 1/2002

(Continued)

OTHER PUBLICATIONS

Dec. 10, 2014—(FR) Search Report—App 1452513.

*Primary Examiner* — David Walczak
*Assistant Examiner* — Joshua Wiljanen
(74) *Attorney, Agent, or Firm* — Banner & Witcoff, Ltd.

(57) ABSTRACT

An applicator for a cosmetic product, in particular mascara, comprises a twisted core and fibers which extend from the core and are held by the core, the core having a main longitudinal direction of extension, known as the main axis (X), and the core being rectilinear along the main axis (X). The fibers form an envelope (E) with their free ends, the envelope (E) comprising faces (F1-F4) which alternate about the main axis (X), the faces (F1-F4) being curved, a cross section made transversely to the main axis (X), known as the cross section, having a substantially polygonal shape so as to form edges between the curved faces (F1-F4).

14 Claims, 5 Drawing Sheets

(56) References Cited

U.S. PATENT DOCUMENTS

| | | | | |
|---|---|---|---|---|
| 8,127,777 | B2 * | 3/2012 | Gueret | A45D 40/267 132/218 |
| 9,033,604 | B2 * | 5/2015 | Gueret | A45D 40/265 401/121 |
| 2002/0020426 | A1 | 2/2002 | Gueret | |
| 2002/0139385 | A1 | 10/2002 | Gueret | |
| 2008/0184512 | A1 * | 8/2008 | Gueret | A45D 40/265 15/206 |

FOREIGN PATENT DOCUMENTS

| | | | | |
|---|---|---|---|---|
| FR | 2973991 | A1 | 10/2012 | |
| FR | WO 2012140572 | A1 * | 10/2012 | A45D 40/262 |
| FR | 2991560 | A1 | 12/2013 | |
| WO | 2009153761 | A2 | 12/2009 | |

* cited by examiner

APPLICATOR FOR A COSMETIC PRODUCT, IN PARTICULAR MASCARA AND METHOD OF PRODUCING SUCH AN APPLICATOR

CROSS REFERENCE TO RELATED APPLICATIONS

This application claims priority to French Application Serial No. 1452513, filed Mar. 25, 2014, which is hereby incorporated by reference in its entirety.

FIELD

The invention relates to an applicator for a cosmetic product, in particular mascara. The invention also relates to a method for producing such an applicator.

BACKGROUND

Mascara applicators may be injection-moulded from plastics material and in this case are generally known as "plastics brushes". They can also be obtained from fibrous elements held between the longitudinal portions of a twisted metal shaft; in this case they are usually called "twisted brushes". Applicators for mascara have a core, or central portion, and bristles extending radially around said core. The ends of said bristles usually form envelopes extending in a longitudinal direction of extension of said brush. The bristles of the twisted brushes are usually known as the "fibres".

The plastic brushes of the prior art have bristles distributed around the core allowing complex envelopes to be produced thus improving the cosmetic effect. With twisted brushes, these features appear more difficult to obtain, unless fibre-cutting operations are used in paths that are difficult to implement.

SUMMARY

The invention proposes the production of a twisted brush, the fibres of which, at their ends, form a complex envelope with advantageous features in cosmetic terms, while remaining relatively simple to obtain.

The invention therefore relates to an applicator for a cosmetic product, in particular mascara, comprising a twisted core and fibres which extend from the core and are held by said core, said core having a main longitudinal direction of extension, known as the main axis, and said core being rectilinear along said main axis.

According to the invention, the fibres form an envelope with their free ends, said envelope comprising faces which alternate about the main axis, said faces being curved, a cross section made transversely to said main axis, known as the cross section, having a substantially polygonal shape so as to form edges between said curved faces. In other words, said faces are each generated by a straight line, known as the straight line generatrix, orthogonal to the main axis and orthogonal to the plane of symmetry of said face.

The invention therefore proposes a twisted brush which has edges at the periphery of the envelope formed by the fibres of which it is composed. This has the advantage of pulling along the eyelashes of a user owing to said eyelashes being grasped by these edges, said edges forming ridge lines. The eyelashes of a user are therefore lengthened, curled and/or combed effectively. Moreover, maintaining a polygon-shaped cross section avoids excessive complexity of manufacture.

Further, the use of a twisted brush allows a greater fibre density than with the bristles of plastic brushes.

According to different embodiments of the invention, which may be taken together or separately:

- the form of said cross section has, at two distinct points of said main axis, an orientation relative to said main axis which is different, in particular an angular orientation about said main axis which is different,
- the core has a distal end and a proximal end, the proximal end being opposite the distal end along the main axis,
- said fibres are distributed along the core, over a substantial portion of its length from the distal end substantially to the proximal end,
- said core consists of a twisted rod,
- said proximal end of the core is prolonged by a portion of the rod that has no fibres,
- said faces have a plane of symmetry containing said main axis,
- all or some of said curved faces are symmetrical in pairs relative to a plane comprising the main axis,
- a pair of said curved symmetrical faces has a substantially convex profile along the main axis, in particular from the distal end to the proximal end of the core,
- a pair of said curved symmetrical faces has a substantially concave profile along the main axis, in particular from the distal end to the proximal end of the core,
- one, and only one, of said curved faces has a substantially concave profile along the main axis, in particular from the distal end to the proximal end of the core,
- a pair of said curved faces, which are opposite relative to the main axis, has the same undulating S-shaped profile,
- the core has a region situated between its distal and proximal ends, known as the intermediate region, in particular substantially equidistant from said distal and proximal ends,
- the envelope comprises two pairs of faces which are symmetrical relative to said main axis, a first pair of faces having a concave undulation from the distal end to said intermediate region and a convex undulation from said intermediate region to the proximal end and a second pair of faces that have a convex undulation from the distal end to said intermediate region and a concave undulation from said intermediate region to the proximal end,
- said envelope has a chamfer in the region of at least one of its faces, at the distal end of said core,
- the applicator forms a brush.

The invention also relates to a method for producing an applicator for a cosmetic product, in particular mascara, said method comprising:

- a step of positioning a plurality of fibres between longitudinal portions of a shaft, then
- a first step of twisting said shaft to form a twisted shaft having fibres that extend radially about said shaft, the ends of said fibres forming a cylindrical envelope that extends in a longitudinal direction of extension around said shaft, then
- a step of cutting the fibres, so that said fibres form an envelope with their free ends, said envelope comprising faces that alternate about the main axis, said faces being curved, a section made transversely to the main axis, known as the cross section, having a substantially polygonal shape so as to form edges between said curved faces, in particular the form of the cross section of the envelope has, at two distinct points of said main axis, an orientation relative to said main axis which is different, in particular an angular orientation about said main axis which is different.

The twisted brush produced in this way has the advantage of having a distribution of fibres, the ends of which form a complex envelope about its core using operations that are nevertheless easy to implement using a cutting step.

According to different embodiments of the invention, which can be taken together or separately:

said twisted shaft is kept rectilinear, said method comprises a second step of twisting said shaft after said fibre cutting step, said cutting is digitally controlled.

The invention also relates to a container for a cosmetic product, in particular mascara, suitable for containing an applicator as described above.

The invention will be better understood, and other objects, details, features and advantages thereof will appear more clearly in the course of the detailed explanatory description that follows of at least one embodiment of the invention given as a purely illustrative and non-limiting example, with reference to the accompanying schematic drawings.

DETAILED DESCRIPTION

Figure 1:
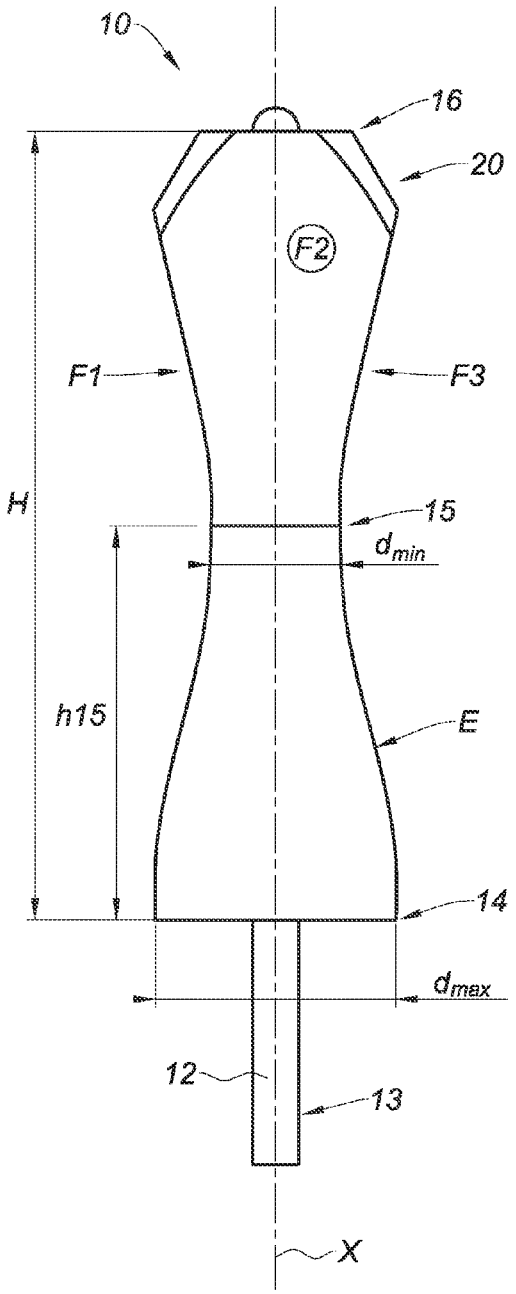
FIG. 1 is a front view of a first embodiment of an applicator according to the invention.

The invention relates to an applicator 10 for a cosmetic product, in particular mascara, comprising a twisted core 12 and fibres which extend from the core 12 and are held by said core 12.

The core 12 is in this case formed by a metal rod, or shaft, comprising two branches, or longitudinal portions, which may be connected to each other by a curved portion. Said metal rod is, for example, folded in two so as to form a "U", the branches of the U then being twisted together.

The fibres extend from the core 12, between a distal end 16 and a proximal end 14 of the core 12. The fibres each have a free end and form an envelope E therewith. FIGS. 1 to 8 illustrate in particular four embodiments of an envelope E according to the invention. The envelope impression will of course be more or less present depending on the density of the fibres.

The applicator 10 extends in a main longitudinal direction of extension, or main axis, which is marked X in FIGS. 1 to 8. This axis X is also the axis of the core 12. The core 12 is therefore straight.

The fibres extend transversely, in particular radially from the core 12, that is, so as to form the envelope E with their free ends, between the distal 16 and proximal 14 ends of the core 12. These ends 14, 16 are opposite relative to the axis X and are separated, along said axis X, by a distance marked H in FIGS. 1, 3, 5 and 7. The distance H is, for example, between 22 mm and 30 mm, and substantially equal, for example, to 22.5 mm or 26 mm, or 27 mm. It should be noted that the proximal end 14 is in this case prolonged by a portion of the rod that has no fibres.

The faces F1-F4 each have, preferably, a plane of symmetry containing the main axis X. In addition, said faces F1-F4 are generated by a straight line, known as the straight line generatrix, which is orthogonal to the core 12 and orthogonal to the plane of symmetry of each of said faces F1-F4. The envelope therefore has a cross section in a plane which is substantially orthogonal to said axis X, the shape of which is a polygon, along the entire length of said core 12, from said distal end 16 to said proximal end 14, said shape being in particular a quadrilateral, or indeed a rectangle, in particular in the region of the intermediate line 15. At least two consecutive faces of said four faces F1-F4 have a curved profile along said main axis X.

In the embodiments shown here, the four faces F1-F4 have a curved profile along said main axis X.

According to the invention, the substantially polygonal shape of the cross section of the envelope E affords various possibilities for the envelope E, each of these possibilities being an envelope E that has edges between said faces F1-F4.

Figure 2:
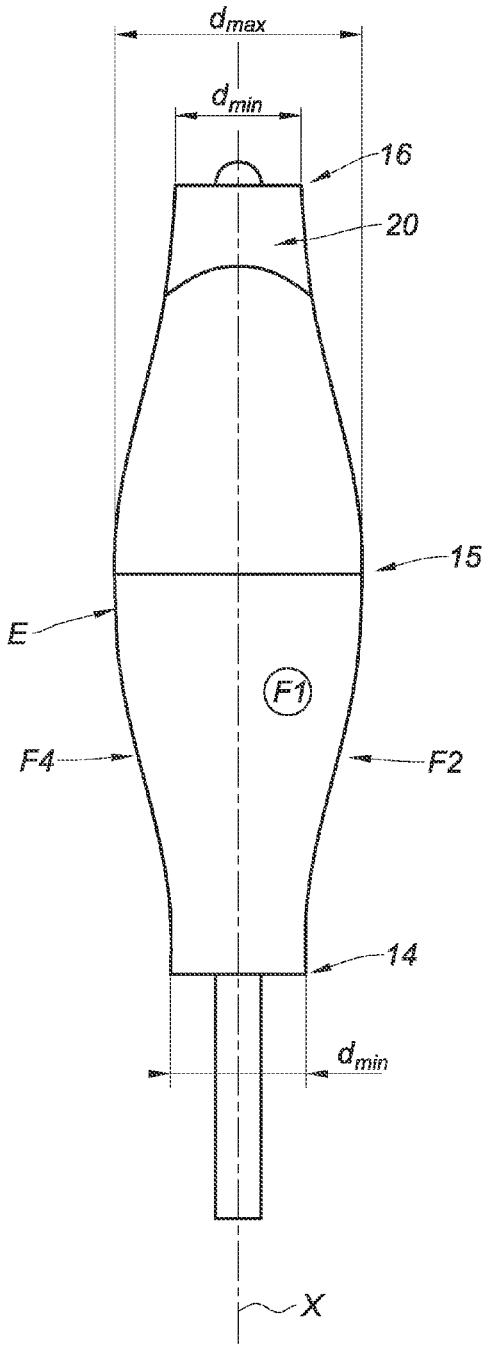
FIG. 2 shows the applicator of FIG. 1 after said applicator has been turned by a quarter turn about its longitudinal axis.
Figure 3:
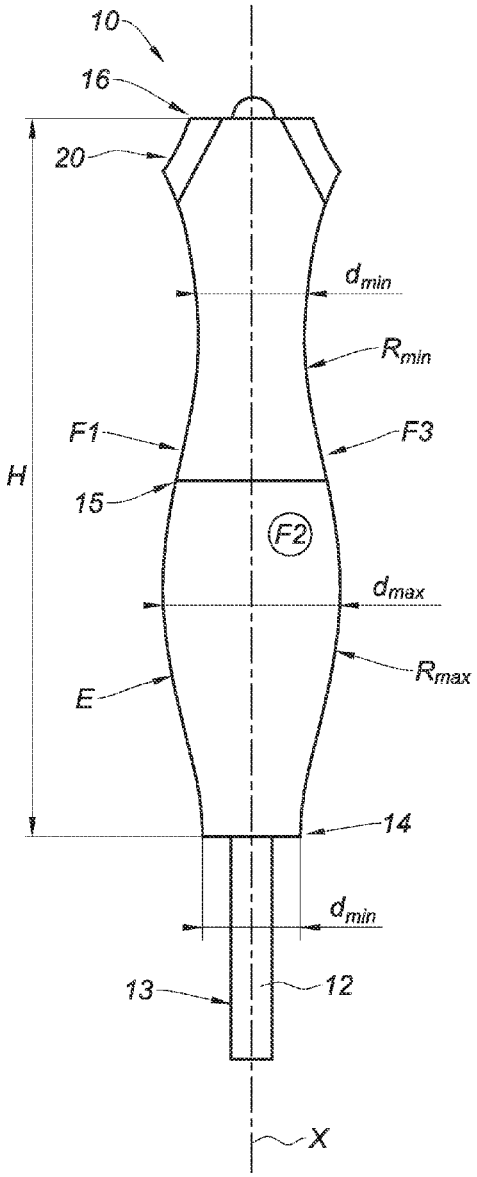
FIG. 3 is a front view of a second embodiment of an applicator according to the invention.
Figure 4:
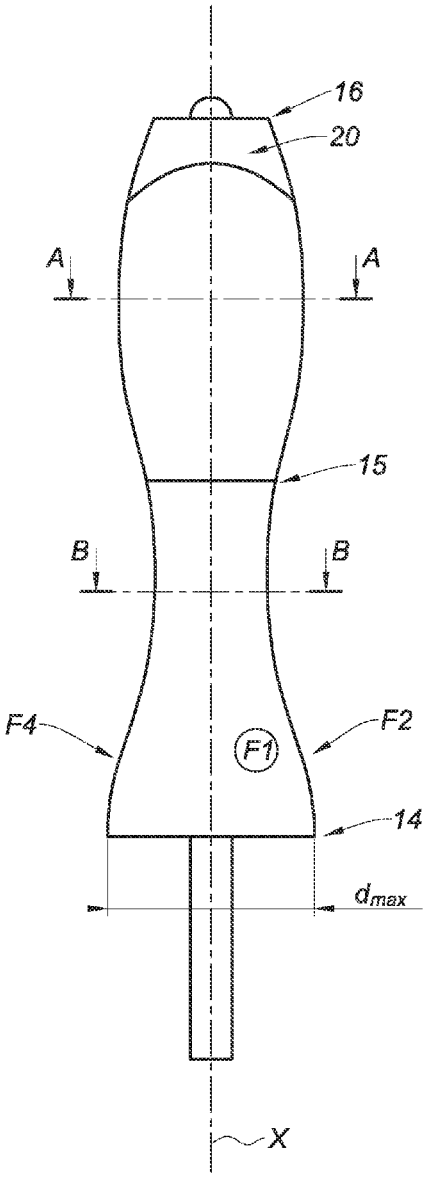
FIG. 4 shows the applicator of FIG. 3 after said applicator has been turned by a quarter turn about its longitudinal axis.

In the embodiment shown in FIGS. 1 and 2 and in the embodiment shown in FIGS. 3 and 4, the envelope E has curved faces F1-F4 with variable slopes or gradients that change direction from one face F1, F3 to the other F2, F4. As well as these changes of direction from one face to the other, the alternation of slopes, or gradients, takes place from the distal end 16 to the proximal end 14. The envelope E therefore has hollows alternating with reliefs around said core 12, that is, when turned about said core in a plane orthogonal thereto and, advantageously, along the entire length of the core 12, from its distal end 16 to its proximal end 14.

Thus, in FIG. 1, the hollows are situated in the vicinity of an intermediate line 15 situated between the distal 16 and proximal 14 ends. Said intermediate line 15 forms part of a plane that is substantially orthogonal to the axis X which comprises an intermediate point of the axis X, said point being advantageously equidistant from said ends 14, 16. The distance h15 separating the proximal end 14 from this intermediate line 15, along said axis X, is substantially equal, for example, to 13 mm. This intermediate line 15 is an imaginary line that follows the periphery of the envelope E.

However, when the applicator 10 is viewed from the side, as shown in FIG. 2, the hollows are close to the distal and proximal ends 14, 16 and the reliefs are close to the intermediate line 15.

The envelope E in the embodiment illustrated in FIGS. 1 and 2 therefore comprises a pair of substantially convex curved faces F2, F4 from the distal end 16 to the proximal end 14 of the core 12.

It should be noted that FIG. 1 shows the face F2 by its contours, in a plane (that of the page); however, the curvature in space of said face F2 can be seen in FIG. 2 where it is shown in profile.

The envelope E of the embodiment illustrated in FIGS. 1 and 2 further comprises a pair of substantially concave curved faces F1, F3 from the distal end 16 to the proximal end 14 of the core 12 (illustrated in FIG. 2, but its curvature in space can be seen in FIG. 1).

In the embodiment illustrated in FIGS. 3 and 4, the hollows are situated between the distal end 16 and the intermediate line 15 and also in the vicinity of the proximal end 14, whereas the reliefs are situated in the vicinity of the proximal end 16 and also between the intermediate line 15 and the proximal end 14.

However, when the applicator 10 is viewed from the side, as shown in FIG. 4, the hollows are situated in the vicinity of the distal end 16 and also between the intermediate line 15 and the proximal end 14, whereas the reliefs are situated between the distal end 16 and the intermediate line 15 and also in the vicinity of the proximal end 14.

The envelope E of the embodiment of FIGS. 3 and 4 therefore comprises a pair of curved faces F1, F3 which have a concave undulation from the distal end 16 to said intermediate line 15 and a convex undulation from said intermediate line 15 to the proximal end 14; the contour of these faces F1, F3 is shown in FIG. 4 but their curvature in space can only be seen in FIG. 3, said faces F1, F3 being seen there in profile.

The envelope E of the embodiment of FIGS. 3 and 4 further comprises a pair of curved faces F2, F4 which have a convex undulation from the distal end 16 to said intermediate line 15 and a concave undulation from said intermediate line 15 to the proximal end 14; the contour of these faces F2, F4 is shown in FIG. 3, and their curvature in space can be seen in FIG. 4.

By way of example, the concave curvatures mentioned above will advantageously have a radius of curvature, marked Rmin in FIGS. 3 and 4, of between 15 and 20 mm and substantially equal to 17 mm. Similarly, the convex curvatures mentioned above will advantageously have a radius of curvature Rmax of between 17.5 and 22.5 mm and substantially equal to 20 mm.

Figure 9:
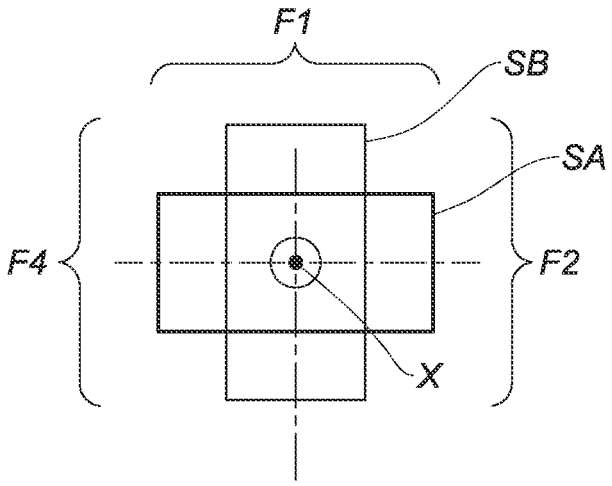
FIG. 9 shows the superposition of the two sections marked A-A and B-B in FIG. 4.

FIG. 9 shows the superposition of two sections marked A-A and B-B in FIG. 4, namely a first section of the envelope E taken between the distal end 16 and the intermediate region 15, marked SA in FIG. 9, and a second section taken between the intermediate region 15 and the proximal end 14, marked SB in the same FIG. 9. It will be seen in FIG. 9 that these two sections SA, SB are rectangles, the lengths of which are offset at an angle of 90° about the main axis X. In other words, the form of the cross section of the envelope E has, at two distinct points of the main axis X, an orientation relative to said main axis X which is different, in particular an angular orientation about said main axis X which is different.

At the location of the section SA, the face F1 is formed by the free ends of radially extending fibres that are shorter than those forming the same face F1 at the location of the section SB. Moreover, the face F1 is framed by the faces F2 and F4 which each have a convex or concave zone at the location of said section SA or said section SB respectively. This means that said face F1 will extend over a length of the rectangle at the location of the section SA rather than over a width of the same rectangle as is the case at the location of the section SB. Therefore, at the location of the section SA, the face F1 has a length close to the main axis X and, at the location of the section SB, a width that is further away from the main axis X.

It should be noted that with regard to the embodiment shown in FIGS. 1 and 2, the form of the cross section of the envelope E also has, at two distinct points of said main axis X, an orientation relative to said main axis X which is different, in particular an angular orientation about said main axis X which is different. For example, a depiction close to that of FIG. 9 will be obtained by taking a section close to the intermediate region 15 of the embodiment shown in FIGS. 1 and 2—the section obtained is equivalent to the section SA of FIG. 9—and a section close to the proximal end 14—a section equivalent to the section SB of FIG. 9.

The envelopes E of the two embodiments that have just been described with FIGS. 1 to 4 and FIG. 9 each comprise two pairs of faces F1, F3 and F2, F4, which are symmetrical in pairs relative to a mid-plane containing the core 12.

Each face belonging to one such pair is opposite to the other face of said pair relative to the core of the brush, indeed it is symmetrical relative to a mid-plane passing through the core, and the two faces of the same pair will have the same slopes, or gradients, in absolute terms because the slopes or gradients change direction from one pair of faces to the other. More specifically, said slopes, or gradients, reverse direction from one pair of faces to the other.

Thus, when the applicator 10 of the invention, according to the two embodiments that have just been described, is viewed from the front, as the observer turns it about the axis of symmetry X of its core 12, he will see faces F1-F4 alternate with slopes that change, and more particularly, faces with slopes that are reversed, alternately over the entire length of the axis X.

These alternating slopes about and along the core 12 advantageously allow the combing surfaces and the loading surfaces to be alternated about and along the applicator 10.

Figure 5:
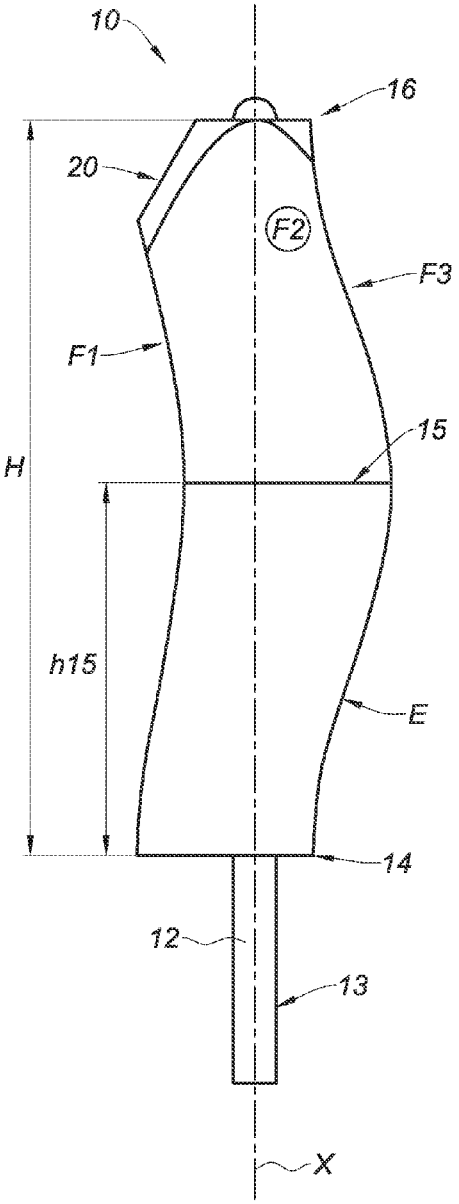
FIG. 5 is a front view of a third embodiment of an applicator according to the invention.
Figure 6:
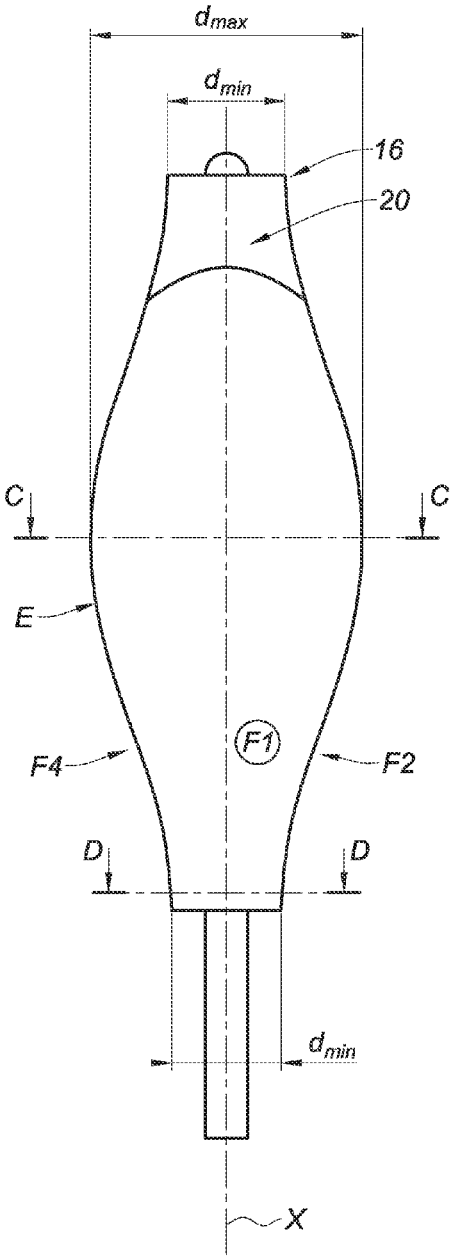
FIG. 6 shows the applicator of FIG. 5 after said applicator has been turned by a quarter turn about its longitudinal axis.

In the embodiment shown in FIGS. 5 and 6, the envelope E comprises, along said main axis X, a substantially concave face F1 and a substantially convex, and opposite, face F3.

The concave face is marked F1 in FIG. 5. This concave face F1 has an extremum in the vicinity of the intermediate line 15.

In FIG. 5, the convex face, opposite the concave face F1, is marked F3. This convex face F3 has an extremum in the vicinity of the intermediate line 15. Opposite face is understood to mean the face F3 which is located opposite the concave face F1 relative to the core 12. In other words, the opposite faces F1, F3 are not in contact.

FIG. 6 shows the applicator 10 when viewed from the side relative to FIG. 5. Here, the form of two faces F2, F4 can be seen, these being the faces that connect said two concave and convex faces F1, F3 which have just been described. Hereinafter, these faces F2, F4 will be referred to as connection faces. In this case, these two connection faces F2, F4 are substantially convex. Said two connection faces F2, F4 have, in particular, an extremum in the vicinity of the intermediate line 15.

It should be noted that FIG. 5 shows the contours of the face F2, in a plane (that of the page); however, the curvature in space of said face F2 can be seen in FIG. 2 where it is shown in profile.

Similarly, the concave face F1, the contours of which are shown in FIG. 6, has a curvature in space that is particularly visible in FIG. 5.

Figure 10:
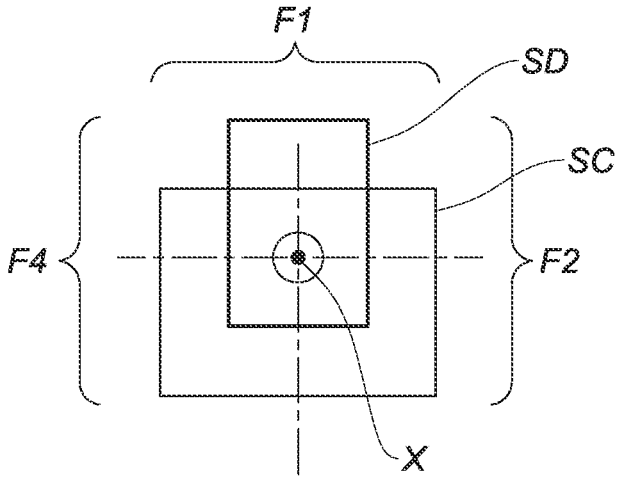
FIG. 10 shows the superposition of the two sections marked C-C and D-D in FIG. 6.

FIG. 10 shows the superposition of the two sections marked C-C and D-D in FIG. 6, namely a first section of the envelope E taken at the intermediate region 15, marked SC in FIG. 10, and a second section taken in the region of the proximal end 14, marked SD in the same FIG. 10. It will be noted, in FIG. 10, that these two sections SC, SD are rectangles, the size and orientation of which differ about the main axis X. In other words, the shape of the cross section of the envelope E has, at two distinct points of said main axis X, an orientation relative to said main axis X which is different, in particular an angular orientation about said main axis X which is different.

At the location of the section SC, the face F1 is formed by the free ends of radially extending fibres that are shorter than those that form the same face F1 at the location of the section SD. Moreover, the face F1 is framed by the faces F2 and F4 as indicated in FIG. 10. Said two faces F2 and F4 each have a convex zone having the domed portion thereof facing outwards, relative to the main axis X, at the location of said section SC. This means that said face F1 will extend over a length of rectangle at the location of the section SC rather than over a width of the same rectangle as is the case at the location of the section SD. Therefore, at the location of the section SC, the face F1 has a length close to the main axis X and, at the location of the section SD, a width that is further away from the main axis X.

The envelope E in the embodiment that has just been described with FIGS. 5, 6 and 10—third embodiment—comprises two pairs of faces F1, F3 and F2, F4. One of the pairs of faces comprises faces F2, F4 which are symmetrical relative to a mid-plane comprising the core 12; these are the faces known as the connection faces F2, F4. The other pair of faces F1, F3 follow substantially the same curve along the main axis X (see FIG. 5). This envelope E has the advantage of optimally curling and loading the eyelashes of the user as it has a concave face formed by fibres of small radial extension which have great loading power.

Figure 7:
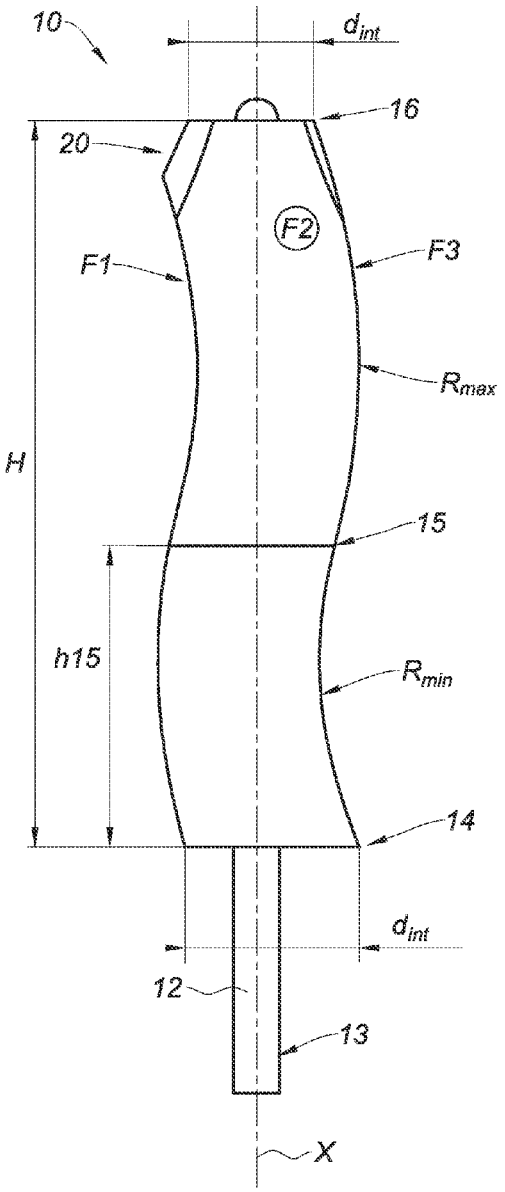
FIG. 7 is a view of a fourth embodiment of an applicator according to the invention.
Figure 8:
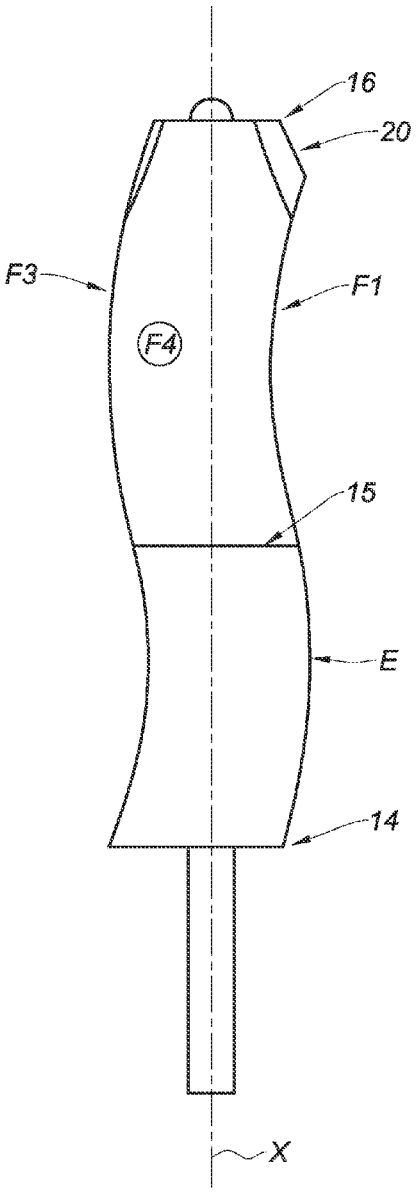
FIG. 8 shows the applicator of FIG. 7 after said applicator has been turned by a half turn about its longitudinal axis.

In the fourth embodiment illustrated in FIGS. 7 and 8, the envelope E comprises, along said main axis X, curved faces, in opposite pairs relative to the main axis X, which have the same undulating S-shaped profile, in particular from the distal end 16 to the proximal end 14 of the core 12. In other words, the envelope E in the embodiment of FIGS. 7 and 8 comprises a pair of curved faces F1, F3 which have an S-shaped undulation along the main axis X which, when the applicator according to the invention is viewed from the front—with the observer looking at the face F2—has the following forms: for F1, a concave form from the distal end 16 to the intermediate line 15 and a convex form from the intermediate line 15 to the proximal end 14, and for F3, a convex form from the distal end 16 to the intermediate line 15 and a concave form from the intermediate line 15 to the proximal end 14 (see FIG. 7).

In the context of this embodiment, the form of the cross section of the envelope E also has, at two distinct points of said main axis X, an orientation relative to said main axis X which is different. For example, by taking a section close to the intermediate region 15, a substantially square shape will be obtained, centred substantially on the main axis X and, by taking a section close to the distal end 14, an off-centre or offset square shape will be obtained relative to said main axis X.

As with the example illustrated in FIGS. 3 and 4, the concave curvatures mentioned above will advantageously have a radius of curvature, marked Rmin, which is between 15 and 20 mm and which is substantially equal to 17 mm. Similarly, the convex curvatures mentioned above will advantageously have a radius of curvature Rmax of between 17.5 and 22.5 mm and substantially equal to 20 mm.

The profile of the envelope E which has just been described—the fourth embodiment—has advantageous cosmetic possibilities, as it allows a fringe of eyelashes to be made up with intensities that differ depending on the eyelashes of which it is composed.

The edges—or lateral borders—are parametric curves in a three-dimensional orthonormal Cartesian point of reference, one of said dimensions being merged with the direction of said axis X, the coordinates of said parametric curves changing in the three directions of said Cartesian point of reference and said parametric curves not merging at any point between said distal 16 and proximal 14 ends.

Said edges therefore have a complex outline while being obtained with faces that are nevertheless easy to produce. This outline is particularly advantageous for grasping and lengthening the eyelashes.

To make it easier to return the brush 10 to its container, the envelope of the applicator 10 may have chamfers 20 in the region of some of its faces, at the distal end 16 of the core 12. This is because the distal end 16 is usually the one that is in contact with the container when the user puts away the applicator 10 after use. Preferably, the envelope comprises at least two opposite faces F1, F3 with chamfers 20 that are symmetrical relative to a mid-plane passing through said core 12. The height of these chamfers 20 will be between 0 (no chamfers) and 5 mm.

It is noteworthy that the width of the envelope E is functionally related to the advantages of the applicator 10; said width varies along the axis X, between the extremes, said extremes being marked dmax, dint and dmin in FIGS. 1 to 7. Moreover, dmax, dmin correspond to the size of the envelope, in the vicinity of the apexes of the reliefs for dmax and of the hollows for dmin. Therefore, the following formula will advantageously be respected:

$0.125 \leq dmin/dmax \leq 0.625$. For example, dmax will be between 6 and 8 mm and dmin will be between 3 and 4.5 mm.

dint corresponds to a size of the envelope E in the particular case of the fourth embodiment. For example, dint will be between 4.5 and 6.5 mm (see FIG. 7).

The invention also relates to a method of producing an applicator for a cosmetic product, in particular mascara, for example the one that has just been described.

This method firstly comprises a step of positioning a plurality of fibres between longitudinal portions of a shaft (not shown). The fibres are distributed in such a way that said longitudinal portions pass substantially through the mid-point of each of said fibres.

The next step of said method is a first step of twisting said shaft to form a twisted shaft having fibres that extend radially about said shaft. The ends of said fibres therefore form a cylindrical envelope extending in a longitudinal direction of extension around said shaft. The fibres are distributed in the form of spirals of fibres owing to the twisting of the shaft.

The next step is a fibre-cutting step, such that said fibres form an envelope E with their free ends, said envelope E comprising faces F1-F4 that alternate about the main axis X, said faces F1-F4 being curved, a section made transversely to the main axis X, known as the cross section, having a substantially polygonal shape so as to form edges between said curved faces F1-F4. Said cutting may be digitally controlled. Throughout these operations, said twisted rod is kept rectilinear.

Advantageously, the portion of the shaft with no fibres which prolongs the proximal end 14 is intended to be fixed inside a hollow rod, itself connected to a sleeve by which the user manipulates said applicator. Said portion may or may not be twisted.

It should be noted that the applicator according to the invention advantageously forms a brush.

It should also be noted that the embodiments shown in FIGS. 1 to 7 might advantageously be combined in order to combine the cosmetic effects thereof, or indeed to obtain new effects therewith.

Furthermore, the fact that four faces are mentioned is not limiting and the applicator 10 may have three, or four, or even six pairs of opposite faces without departing from the scope of the invention.

It should also be noted that variants are of course possible. In particular, an embodiment that is not illustrated here can also be envisaged which has an envelope E that is helical in shape. In other words, the borders of the faces described above may follow a helix from the proximal end 14 to the distal end 16 of the applicator 10, for example by means of a second twisting step of the method according to the invention.

We claim:

1. Applicator for a cosmetic product, in particular mascara, comprising a twisted core and fibres which extend from the core and are held by said core, said core having a main longitudinal direction of extension, known as the main axis (X), and said core being rectilinear along said main axis (X), characterised in that the fibres form an envelope (E) with their free ends, said envelope (E) comprising faces (F1-F4) which alternate about the main axis (X), said faces (F1-F4) being curved, a section made transversely to said main axis (X), known as the cross section, having a substantially polygonal shape so as to form edges between said curved faces (F1-F4), the form of said cross section having, at two distinct points of said main axis, an angular orientation about said main axis which is different.

2. Applicator according to claim 1, wherein said faces (F1-F4) have a plane of symmetry containing said main axis (X).

3. Applicator according to claim 2, wherein a pair of said curved faces (F1, F3), which are opposite relative to the main axis (X), has the same undulating S-shaped profile relative to the main axis (X).

4. Applicator according to claim 1, wherein all or some of said curved faces (F1-F4) are symmetrical in pairs relative to a plane comprising the main axis (X).

5. Applicator according to claim 4, wherein a pair of said curved symmetrical faces (F2, F4) has a substantially convex profile along the main axis (X).

6. Applicator according to claim 5, wherein a pair of said curved symmetrical faces (F1, F3) has a substantially concave profile along the main axis (X).

7. Applicator according to claim 4, wherein a pair of said curved symmetrical faces (F1, F3) has a substantially concave profile along the main axis (X).

8. Applicator according to claim 1, wherein one, and only one, of said curved faces (F1) has a substantially concave profile along the main axis (X).

9. Applicator according to claim 1, wherein a pair of said curved faces (F1, F3), which are opposite relative to the main axis (X), has the same undulating S-shaped profile.

10. Container for a cosmetic product, in particular mascara, suitable for containing an applicator according to claim 1.

11. Method for producing an applicator for a cosmetic product, in particular mascara, said method comprising:

a step of positioning a plurality of fibres between longitudinal portions of a shaft, then a first step of twisting said shaft to form a twisted shaft having fibres that extend radially about said shaft, the ends of said fibres forming a cylindrical envelope that extends in a longitudinal direction of extension around said shaft, known as the main axis (X), then a step of cutting the fibres, so that said fibres form an envelope (E) with their free ends, said envelope (E) comprising faces (F1-F4) that alternate about the main axis (X), said faces (F1-F4) being curved, a section made transversely to the main axis (X), known as the cross section, having a substantially polygonal shape so as to form edges between said curved faces (F1-F4), the form of said cross section having, at two distinct points of said main axis, an angular orientation about said main axis which is different.

12. Method according to claim 11, comprising a second step of twisting said shaft after said fibre cutting step.

13. Applicator for a cosmetic product, in particular mascara, obtained by the method according to claim 12.

14. Applicator for a cosmetic product, in particular mascara, obtained by the method according to claim 11.

* * * * *